US008186272B2

(12) United States Patent
Reichelsheimer et al.

(10) Patent No.: US 8,186,272 B2
(45) Date of Patent: May 29, 2012

(54) METHOD AND SYSTEM FOR DRYING INK ON A SUBSTRATE MATERIAL

(75) Inventors: Jay Reichelsheimer, Shelton, CT (US); Richard A. Sloan, Jr., Southbury, CT (US); George M. Macdonald, New Canaan, CT (US)

(73) Assignee: Pitney Bowes Inc., Stamford, CT (US)

( * ) Notice: Subject to any disclaimer, the term of this patent is extended or adjusted under 35 U.S.C. 154(b) by 720 days.

(21) Appl. No.: 11/966,454

(22) Filed: Dec. 28, 2007

(65) Prior Publication Data

US 2009/0165329 A1 Jul. 2, 2009

(51) Int. Cl.
*B41L 35/14* (2006.01)

(52) U.S. Cl. ..... 101/488; 101/484

(58) Field of Classification Search ..... 101/484, 101/488

See application file for complete search history.

(56) References Cited

U.S. PATENT DOCUMENTS 4,469,026 A * 9/1984 Irwin ..... 101/484
4,864,505 A * 9/1989 Miller et al. ..... 705/410
5,301,044 A * 4/1994 Wright ..... 358/500
5,373,312 A * 12/1994 Fujioka et al. ..... 347/102
5,784,090 A * 7/1998 Selensky et al. ..... 347/102
5,906,862 A * 5/1999 Yapel et al. ..... 427/378
6,025,200 A * 2/2000 Kaish et al. ..... 436/56
6,615,733 B2 * 9/2003 Kowada ..... 101/488
6,926,764 B2 * 8/2005 Bleikolm et al. ..... 106/31.27
7,040,232 B2 * 5/2006 Van Holten et al. ..... 101/484
7,829,162 B2 * 11/2010 Eskra et al. ..... 428/32.69
2001/0001560 A1 * 5/2001 Ruhe ..... 347/102
2002/0112628 A1 * 8/2002 Irick ..... 101/424.1
2006/0038979 A1 * 2/2006 Natan et al. ..... 356/71
2006/0293409 A1 * 12/2006 Sanchez et al. ..... 523/160

* cited by examiner

*Primary Examiner* — Anthony Nguyen
(74) *Attorney, Agent, or Firm* — Brian A. Collins; Charles R. Malandra, Jr.; Steven J. Shapiro

(57) ABSTRACT

A method and system for drying printed ink on the face of a substrate material such as a mailpiece. The method comprising the steps of (i) providing a dryer having at least one variable output element for producing a plurality of dryer configurations, (ii) developing data correlating each of the dryer configurations with at least one print characteristic, (iii) storing the developed data in a memory storage device, (iv) obtaining the print characteristic associated with a particular print job and comparing the print characteristic with the developed data to define a desired dryer configuration, (v) adapting the dryer to assume the desired dryer configuration based upon the print characteristic, and (vi) drying the ink printed on the face of the substrate material. The system may include a taggant introduced into the ink and a means for identifying the taggant to determine the type of ink and the desired dryer configuration.

7 Claims, 3 Drawing Sheets

METHOD AND SYSTEM FOR DRYING INK ON A SUBSTRATE MATERIAL

FIELD OF THE INVENTION

The present invention relates to a method and system for drying ink, and, more particularly, to a method and system for rapidly drying ink on substrate material which is stacked immediately following print operations. The invention prevents smearing/smudging as a consequence of the subsequent handling/stacking operations.

BACKGROUND OF THE INVENTION

Automated mailpiece fabrication employs a variety of systems, devices and processes dedicated to perform specific sheet/media handling operations. These may include, inter alia, (i) mailpiece inserters dedicated to insert/fill envelopes with mailpiece content material, (ii) mailing machines/meters adapted to perform additional processing tasks such as moistening/sealing the envelope flap, weighing the completed/finished mailpiece, and applying/printing postage indicia for mailpiece delivery and (iii) envelope printing apparatus (both in-line and shuttle type) adapted to rapidly print mailpiece information (e.g., destination and return addresses) on a face of the envelope. When processing a small number of mailpieces or insufficient number to obtain "sorted mail" discounts (i.e., available through the Manifest Mailing System (MMS)), printed mailpieces are typically allowed to randomly fall into an open container. Alternatively, when printing a large number of conventional-size mailpieces (i.e., type ten envelopes) eligible for USPS sorted mail discounts, the printed mailpieces may be neatly shingled and stacked for subsequent containment within a tray container.

The process of stacking/arranging mailpieces suitable for sorted mail discounts may be performed by a conveyor stacker, such as the type described in Sloan Jr. et al. U.S. Pat. No. 6,817,608. The stacker is an upright module having a conveyor system (i.e., a deck defined by one or more conveyor belts) which is disposed adjacent to, and essentially co-planar with, the output of the mailpiece printer. The conveyor system defines a feed path which is at right angles to, or essentially orthogonal with, the output path of the printer and includes stepped upstream and downstream segments. The upstream segment is vertically raised and operates at an increased speed relative to the downstream segment. As mailpieces exit the printer, the conveyor deck of the upstream segment receives mailpieces such that a space or gap is created between adjacent mailpieces. As the mailpieces move from the upstream to downstream segments, the mailpieces traverse a vertical step produced by the height differential between the segments. Inasmuch as the conveyor speed of the downstream segment is reduced relative to the upstream segment, mailpieces fall one atop another and shingle as the downstream segment slowly moves the mailpieces away from the vertical step. As the mailpieces continue downstream, a wedge or stacking ramp causes the mailpieces to assume an on-edge orientation to augment the removal and stacking of mailpieces within a tray container.

In addition to effecting the desired mailpiece arrangement and orientation, the conveyor stacker may include a high-output dryer for the purpose of drying the ink printed on the face of each mailpiece. The dryer is disposed over the conveyor deck of the upstream conveyor segment and produces a high-temperature flow of air over the face of each mailpiece. More specifically, the dryer includes a resistive heating element, one or more propulsive fans for directing ambient air over and around the heating element, and a louvered register for ducting the heated air over the mailpieces at a desired angle. With respect to the latter, the louvers of the register are disposed at an acute angle relative to the plane (i.e., substantially horizontal plane) defined by the underlying mailpieces. Specifically, the louvers are disposed at an angle of about thirty-five (35) degrees relative to the horizontal. As such, a horizontal component of the resultant airflow vector is produced which lies parallel to, and in the same direction as, the conveyor deck (i.e., movement of the mailpieces). A conveyor stacker, such as the type described above, is produced by Pitney Bowes Inc. of Stamford, Conn. under the tradename "DA400 Dryer/Stacker".

The dryer functions to rapidly evaporate the ink solvent, thereby preventing the opportunity for the printed ink to smear or smudge when the face surfaces of the mailpieces are juxtaposed and/or contiguous, i.e., upon being shingled, raised on-edge and stacked. It will, therefore, be appreciated that the rate of mailpiece stacking is not solely a function of the conveyor deck speed, i.e., the speed of the upstream and downstream segments, but also a function of the rate of ink drying.

The rate of ink drying and associated print quality (e.g., the sharpness of the images edges) on the face of an envelope is a function of variety of factors including the efficacy of the drying apparatus, the characteristics of the ambient environment, and the properties of both the envelope and the ink. With respect to the dryer, factors include (i) the radiant heat energy produced by the heating element, (ii) the convective heat transfer between the heating element and the airflow produced by the propulsive fan(s), (iii) the convective heat transfer between the ink and the heated airflow due to the rate of air flowing over the envelope, i.e., the quantity of air moved by the propulsive fan(s), (iv) the convective heat transfer between the ink and the heated airflow due to the direction of air flowing over the envelope, i.e., through the louvers of the register, and (v) the proximity of the heating element to the envelope, i.e., the separation distance therebetween.

With respect to the characteristics of the ambient environment, factors include the ambient air conditions surrounding the dryer. For example, should humid conditions exist, e.g., 70% latent heat, evaporation will occur slowly and, so too, will the rate of ink drying. Concerning the properties of the paper and/or ink, factors affecting the drying time include, inter alia, (i) the type of paper used in the fabrication of the envelope, e.g., flat, satin, or glossy finish, etc., (ii) the evaporative properties of the ink solvent, and (iii) the viscous/molecular properties of the ink e.g., properties of the ink to flow, surface tension, etc. With respect to the viscous/molecular properties, a low viscosity, low surface tension ink will flow, spread or flatten when a bead or drop is applied to a surface. That is, the diameter and/or area of a circular drop will enlarge under the forces of gravity and/or due to the lack of strong molecular bonds. This increased area has the effect of increasing the surface area available for heat transfer, wicking action (into the underlying substrate material), and evaporation. Hence, an advantage of low viscosity/surface tension inks is their ability to dry rapidly. A disadvantage, however, relates to a decrease in edge sharpness, and commensurate reduction in print quality.

Dryers of the prior art offer a single solution to drying ink, i.e., a fixed geometric configuration for a variable set of conditions. Such prior art dryers are, therefore, non-optimum whenever unique conditions exist, or, alternatively, wherever conditions differ from those originally addressed by the dryer. For example, should a high viscosity, slow drying ink be employed to print envelopes, prior art dryers may be unable to provide the necessary heat transfer necessary to dry the ink, i.e., before contact between mailpieces causes smearing or smudging. Alternatively, prior art dryers may produce more than sufficient heat output to dry a low viscosity, fast drying ink. Consequently, an opportunity to reduce the power consumed by the dryer may be lost.

A need therefore exists, to provide a method and system for drying ink on a substrate material which produces an optimum heat output based upon a variety of sensed parameters.

SUMMARY OF THE INVENTION

A method and system is provided for drying printed ink on the face of a substrate material such as a mailpiece. The method comprising the steps of (i) providing a dryer having at least one variable output element for producing a plurality of dryer configurations, (ii) developing data correlating each of the dryer configurations with at least one print characteristic, (iii) storing the developed data in a memory storage device, (iv) obtaining the print characteristic associated with a particular print job and comparing the print characteristic with the developed data to define a desired dryer configuration, (v) adapting the dryer to assume the desired dryer configuration based upon the print characteristic, and (vi) drying the ink printed on the face of the substrate material. The system includes a taggant introduced into the ink of a print job and a means for identifying the taggant to determine the type of ink and the desired dryer configuration.

BRIEF DESCRIPTION OF THE DRAWINGS

Further details of the present invention are provided in the accompanying drawings, detailed description, and claims.

DETAILED DESCRIPTION

A method and system for drying ink will be described in the context of a mailpiece dryer/stacker, though the invention is not limited to drying ink printed on mailpieces or to sheet material conveyed on a stacking device. The stacker/dryer is merely illustrative of a useful adaptation of the inventive teachings and the invention should be interpreted broadly in the context of the specification and appended claims.

Figure 1:
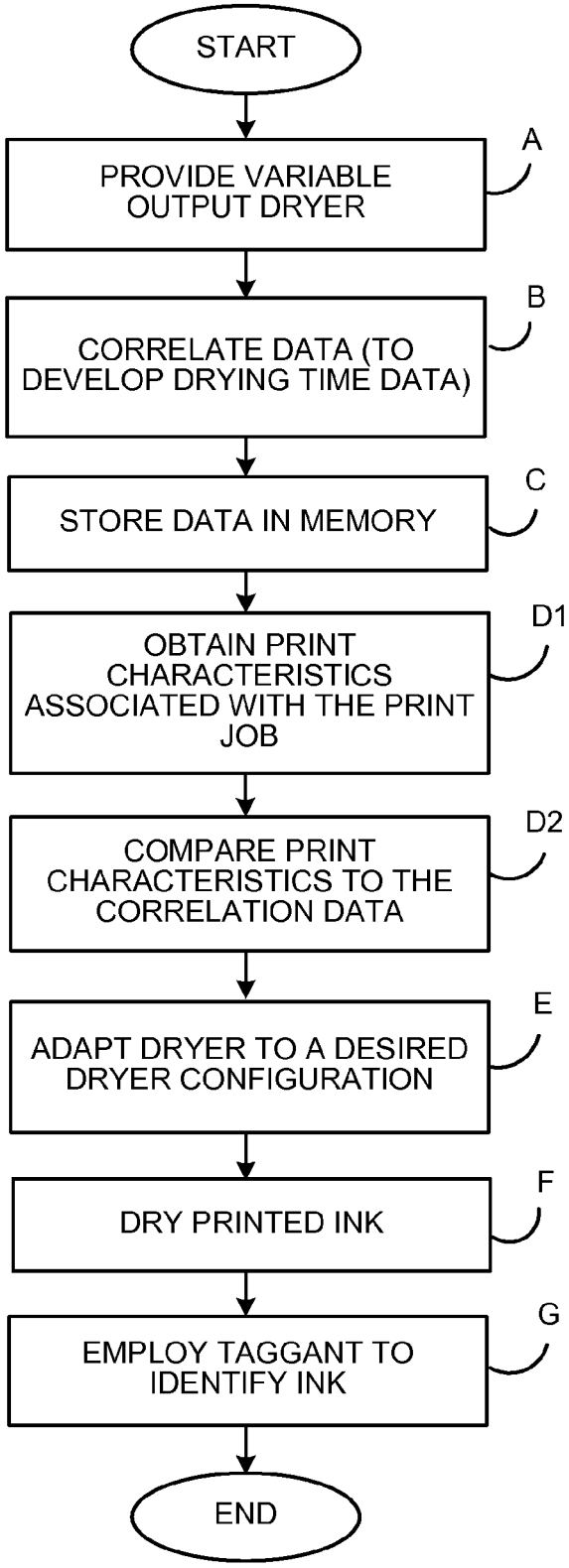
FIG. 1 is a flow diagram of the method steps employed when practicing the teachings of the present invention.

In FIG. 1, a flow diagram illustrates the principle method steps employed to practice the invention. In a first step A, a variable output dryer (described in greater detail below) includes at least one drying/heating element which may be controlled or reconfigured to vary the output of the dryer. In step B, data is developed (i.e., drying time data) to correlate various dryer configurations with at least one print characteristic employed when printing on a substrate material such as a mailpiece envelope. While the various print characteristics will be discussed at length in the subsequent paragraphs, such print characteristics relate to any (i) property of the ink, (ii) construction of the underlying substrate material influencing the absorption or flow of ink, or (iii) print commands impacting the amount of ink deposited on the substrate material, which impact drying.

Once this data is collected and analyzed, the data is stored and/or organized in a memory storage device, in a step C, for use by a system processor. When performing a particular print job, the specific or pertinent print characteristics associated with the print job are obtained or retrieved in a step D1. Further, in step D2, the print characteristic is compared with the developed data to define a dryer configuration. In step E, the variable output dryer is adapted to assume the dryer configuration based upon the print characteristic and the print job is executed in Step F to dry the ink printed on the substrate material. In an alternate embodiment of the invention, a taggant may be employed in a step G to identify the ink and its ink properties to augment the efficacy of the drying process and operation of a stacker/dryer. The following description discusses each of the foregoing steps in greater detail.

Figure 2:
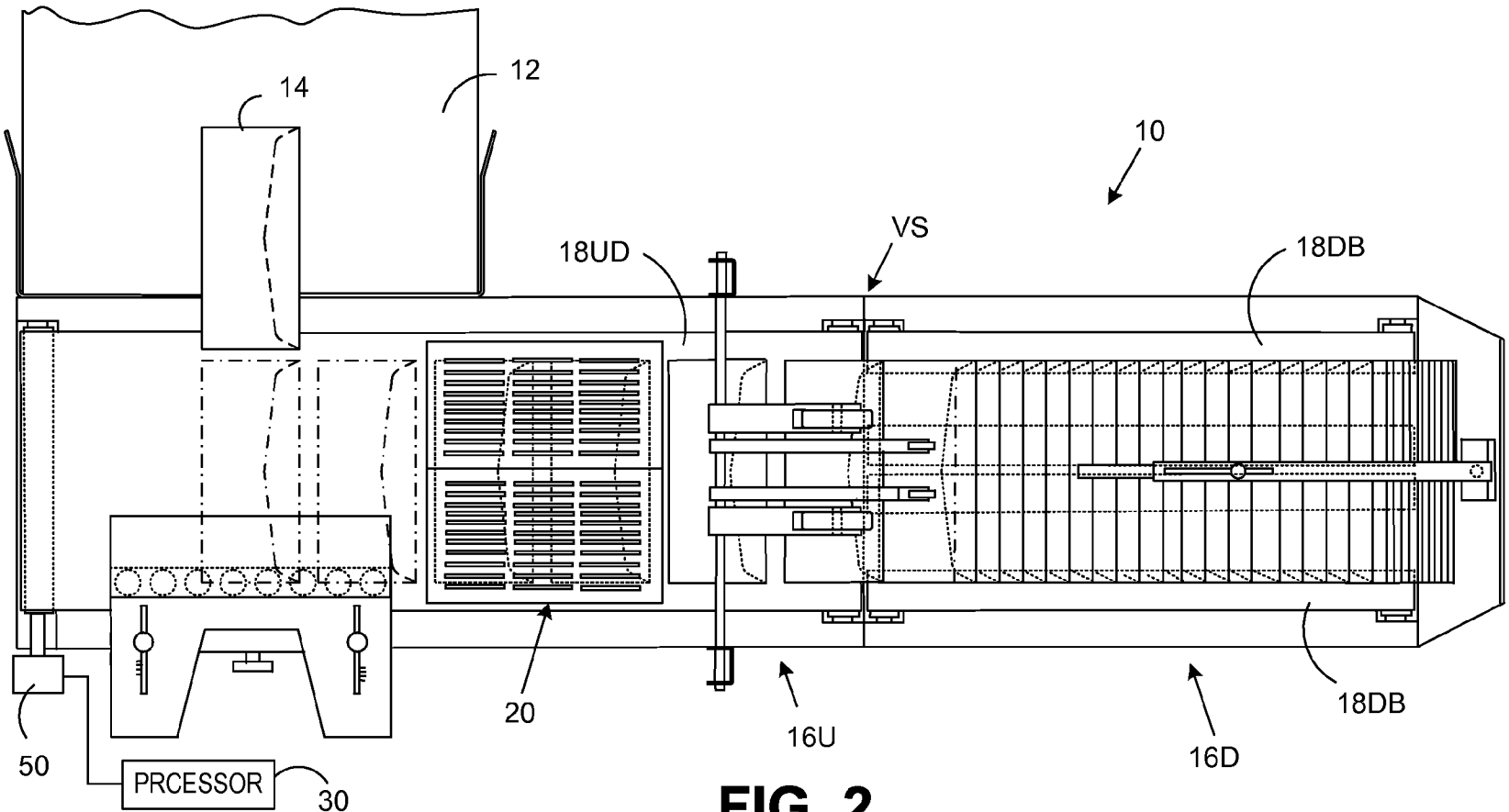
FIG. 2 is a top view of a mailpiece stacker having a dryer capable of varying its output based upon the print characteristics of a print job.
Figure 3:
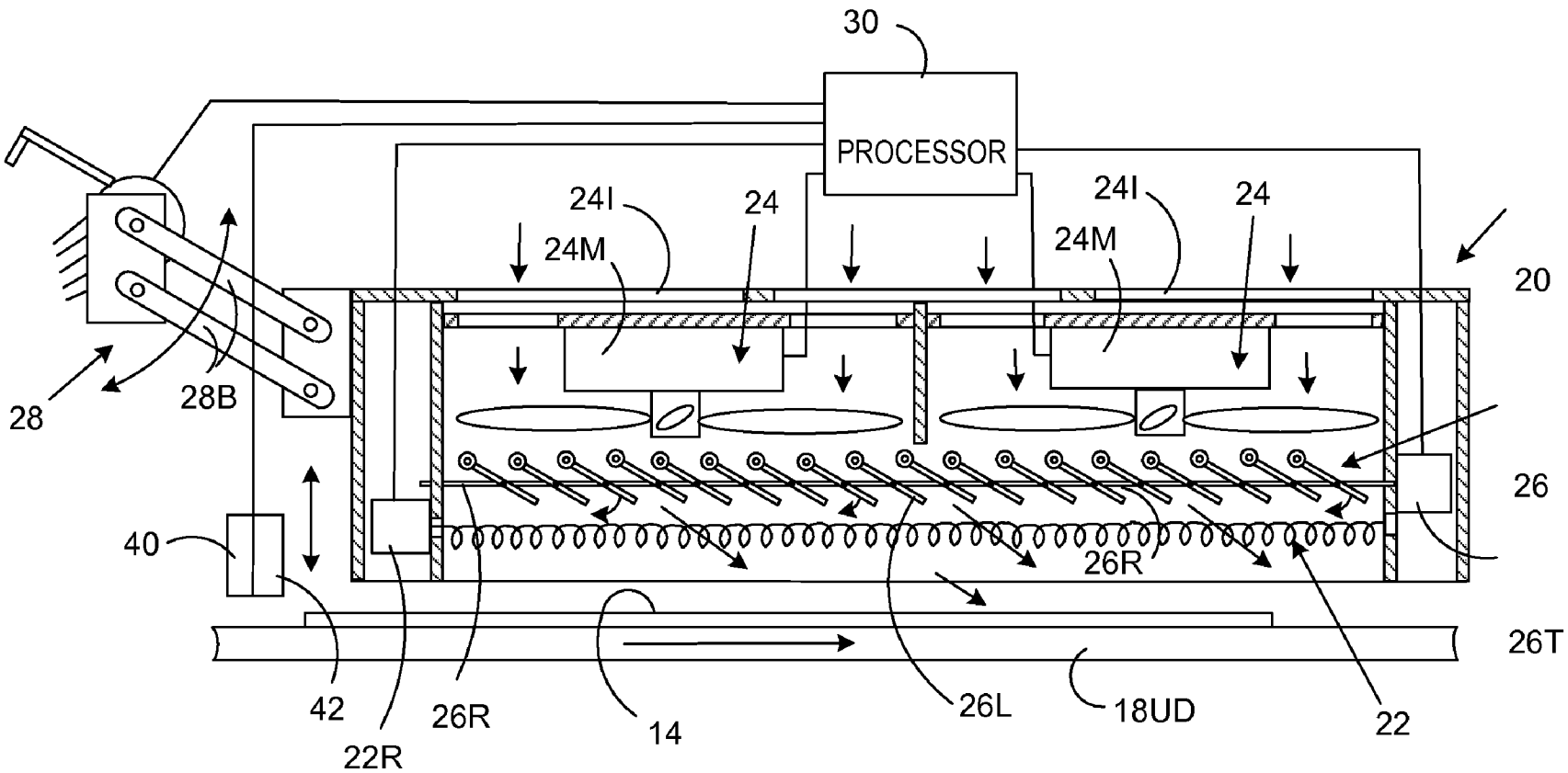
FIG. 3 is a schematic side view of the variable output dryer including a system processor for controlling various reconfigurable elements/components of the dryer.

In FIGS. 2 and 3, a stacker/dryer 10 is disposed adjacent to a mailpiece printer 12 for receiving printed mailpieces 14. The mailpiece printer 12 may be configured for shuttle or in-line printing, though an in-line printer, i.e., a printer having print heads/cartridges dedicated to specific "print zones", is generally preferable for high output print jobs. The stacker dryer 10 includes upstream and downstream conveyor segments 16U, 16D wherein the upstream segment is raised relative to the downstream segment to produce a vertical step VS between the segments 16U, 16D. Furthermore, a single conveyor deck 18UD associated with the upstream segment 16U travels at a relative high feed rate (i.e., relative to the feed rate of a plurality of downstream belts 18DB) to effect a small space/gap between mailpieces 14 as they are laid on the deck 18UB. That is, individual mailpieces 14 are laid without stacking or shingling of mailpieces on the upstream conveyor segment 16U. As the mailpieces 14 move from the upstream to downstream segments 16U, 16D, the lower feed rate of the downstream belts 18DB causes the mailpieces 14 to collect, stack and shingle. Furthermore, the vertical step VS between the segments 16U, 16D augments the stacking of mailpieces 14 by accommodating the requisite change in vertical height, i.e., from one mailpiece 14 to the next.

In advance of the vertical step VS, the upstream conveyor segment 16U includes a variable output dryer 20 disposed over and proximal to the conveyor deck 18UD. In FIGS. 1 and 2, the variable output dryer 20 includes (i) a heating element 22, (ii) propulsive fans 24 operative to direct air flow across the heating element 22, (iii) a ducting register 26 for directing air flow over each mailpiece 14, (iv) a mounting means 28 operative to vary the proximity of the dryer relative to an underlying mailpiece 14, and (v) a means 30 for controlling each of the foregoing elements/items, 22, 24, 26, 28, to vary the output of the dryer 20.

More specifically, the power/energy supplied to the heating element 22 may be varied by a conventional voltage rheostat 22R. Similarly, the speed of the propulsive motor 24M may be varied to change the flow rate i.e., measured in Cubic-Feet/Min (CFM) of the propulsive fan 24. Alternatively, the in-flow of air to the propulsive fan 24 may be restricted or permitted to flow more freely. Such flow variation may be effected by a moveable plate (not shown) disposed over the in-flow air apertures/slots 24I to regulate the air flowing into the propulsive fan 24. A Linear Variable Displacement Transducer (LVDT) 26T may displace a rod 26R which connects to each louver 26L of the ducting register 26. Linear displacement of the rod 26R collectively pivots the louvers 26L to direct the air flow exiting the dryer 20. Finally, the proximity of the dryer 20 to an underlying mailpiece 14 may be controlled by varying the angular position of a four-bar linkage arrangement 28B. The four-bar linkage 28B mounts the dryer 20 to a stationary housing structure (not shown) and effects linear displacement of the dryer 20 upon rotating a pivoting shaft of the linkage 28B. The means 30 for controlling the various elements/items 22, 24, 26, 28 is a conventional processor and will be discussed in greater detail when describing the steps and operation of the inventive method.

The variable output dryer 20 may be adapted to assume various configurations which change, e.g., intensify or ameliorate, the dryer output. For example, one dryer configuration may include: (1) a mounting arrangement 28 configured to position the dryer 20 two inches (2") above the conveyor deck, (2) a heating element 22 set to consume/generate two-thousand watts (2000 W) of power, (3) propulsive fans 24 driven to move air at a rate of 300 Cubic-Feet/Min (CFM), and (4) a ducting register 26 having louvers 26L positioned at fifteen degrees (15°) to optimally move air across the mailpiece 14. Others may include various power settings for the heating element, e.g., 1500 W, 2000 W, and 2500 W, a plurality of fan settings, e.g., 250, 300 and 400 CFM, a range of louver positions, e.g., 35°, 25° and 15°, and multiple dryer position settings relative to the mailpiece 14, e.g., 2", 2.5" and 3".

In addition to the various configurations of the variable output dryer 20, the information printed on the face of the mailpiece 14 can have various print characteristics which affect the rate of ink drying. As used herein, a "print characteristic" is any property of the ink, print process/command or fabrication/construction of the underlying substrate which can influence the rate or time taken to dry the ink on the substrate material. These print characteristics may include the type of ink employed when printing, the manner in which the printer/print driver deposits the ink, and/or the type/kind of paper used to fabricate an envelope. With respect to the former, and as previously discussed in the Background of the Invention, the ink may be viscous, i.e., resistant to fluid flow, and, consequently, slow drying. Similarly, the ink may exhibit molecular bonds, i.e., surface tension properties, tending to maintain a nearly spherical shape. These molecular bonds resist forces tending to spread or increase the surface area of a droplet of ink. As such, less surface area is available for evaporation to the ambient environment and/or for wicking/absorption by the substrate fiber-matrix (discussed in greater detail below). Alternatively, the printed ink may include a highly evaporative solvent, such as Methyl-Ethyl Ketone (MEK), which can accelerate the rate of ink drying.

With respect to the manner in which the printer deposits the ink, the various print settings will impact the amount of ink deposited and the rate of drying. For example, a "regular" print type will dry more rapidly than a "bold" print type. A fifty-percent (50%) grey-scale setting will dry faster than a ninety-percent (90%) grey-scale setting. And, a high resolution print command, e.g., 600 dots per inch (dpi), will produce print which requires more time to dry than a lower resolution print, e.g., 300 dots per inch (dpi). It will be appreciated that the foregoing print characteristics are directed to the amount of ink deposited rather than the properties of the ink and/or substrate material.

Fibers in the substrate material and/or the matrix which binds the fibers can effect a wicking action which increases or decreases the rate of drying. For example, a highly absorbent "flat" substrate material will tend to be porous, i.e., have voids between the reinforcing fibers, and freely receives the flow of ink. In addition to absorbing the ink, the flow increases the area available for evaporation to dry the ink at a rapid rate. Conversely, a substrate material which is less absorbent, e.g., wax paper, is less porous and slows the drying process. That is, a high resin/adhesive content binding matrix will tend to fill the voids and decrease the influx of ink. Furthermore, the ink does not spread and evaporation occurs at a slower pace.

Once the configurations of the variable output dryer are known and the print characteristics are classified, empirical and/or analytical data may then be generated to correlate the various dryer configurations with the print characteristics. Further, this data will be used to determine the time required for drying and the optimum dryer configuration for a particular print job. For example, a fast drying ink may enable the stacker to increase throughput, i.e., the number of mailpieces dried & stacked per unit time, by increasing the speed of its conveyor belts. Alternatively, a trade-off between throughput and power consumption may be warranted. Consequently, the conveyer belts may be slowed to decrease the output power required, i.e., of the variable output dryer, and yield a more suitable/optimum solution.

Tables I through IV below are illustrative of the various data/information which may be obtained to practice the teachings of the inventive method and system. These Tables are intended to provide a small sample of each data set and are not intended to provide an exhaustive/complete set of data which may be used in the method and system of the present invention. From this point of reference, Table I provides data relating to the various dryer configurations which may be analyzed. Configurations which vary the power to the heating element (Column 2), fan speed (Column 3), the in-flow area to the fan(s) (Column 4), the louver angle of the ducting register (Column 5) and separation distance between the dryer and the mailpiece (Column 6), are among those which may be tested.

Table II provides data/information relating to the various inks which may be employed. The properties of interest may include the color of the ink (Column 2), the ink viscosity (Column 3), and the surface tension properties (Column 4). A taggant (Column 5) may also be employed (discussed in greater detail below) to identify the ink. Tables III and IV provide data/information relating to the print process and substrate material, respectively. In Table III, printer data relating to the print font (Column 2), print type (Column 3) and print resolution (Column 4) may be useful to determine the amount of ink deposited on the substrate material. Table 4 relates to the types of substrate material which may be more or less absorbent.

TABLE I

VARIABLE OUTPUT DRYER CONFIGURATION

| CONFIG. NUMBER | HEATING ELEMENT | FAN SPEED | IN-FLOW AREA | LOUVER ANGLE | SEPARATION DISTANCE |
|---|---|---|---|---|---|
| 1 | 2000 W | 50 CFM | 20 $in^2$ | 15 degrees | 2.0 inches |
| 2 | 2000 W | 50 CFM | 20 $in^2$ | 25 degrees | 2.0 inches |
| 3 | 2000 W | 50 CFM | 20 $in^2$ | 35 degrees | 2.0 inches |
| 4 | 2500 W | 50 CFM | 20 $in^2$ | 15 degrees | 3.0 inches |
| 5 | 2500 W | 50 CFM | 20 $in^2$ | 25 degrees | 3.0 inches |
| 6 | 2500 W | 50 CFM | 20 $in^2$ | 35 degrees | 3.0 inches |
| 7 | 3000 W | 50 CFM | 20 $in^2$ | 15 degrees | 4.0 inches |
| 8 | 3000 W | 50 CFM | 20 $in^2$ | 25 degrees | 4.0 inches |
| 9 | 3000 W | 50 CFM | 20 $in^2$ | 35 degrees | 4.0 inches |
| 10 | 2000 W | 60 CFM | 20 $in^2$ | 15 degrees | 2.0 inches |
| 11 | 2000 W | 60 CFM | 20 $in^2$ | 25 degrees | 2.0 inches |
| 12 | 2000 W | 60 CFM | 20 $in^2$ | 35 degrees | 2.0 inches |
| 13 | 2500 W | 60 CFM | 20 $in^2$ | 15 degrees | 3.0 inches |
| 14 | 2500 W | 60 CFM | 20 $in^2$ | 24 degrees | 3.0 inches |
| 15 | 2500 W | 60 CFM | 20 $in^2$ | 35 degrees | 3.0 inches |
| 16 | 3000 W | 60 CFM | 20 $in^2$ | 15 degrees | 4.0 inches |
| 17 | 3000 W | 60 CFM | 20 $in^2$ | 25 degrees | 4.0 inches |
| 18 | 3000 W | 60 CFM | 20 $in^2$ | 35 degrees | 4.0 inches |

TABLE II

| INK CHARACTERISTICS AND IDENTIFIER | | | | | |
|---|---|---|---|---|---|
| NUMBER | INK COLOR | INK VISCOSITY | SURF. TENSION PROPERTIES | EVAPORATIVE SOLVENT | INK TAGGANT |
| 1 | Black | 20 PA-S | 28 DYNES/CM | 90% H20-10% IAL | Florescent Blue |
| 2 | Black | 25 PA-S | 28 DYNES/CM | 90% H20-10% IAL | Florescent Orange |
| 3 | Black | 30 PA-S | 28 DYNES/CM | 90% H20-10% IAL | Florescent Red |
| 4 | Black | 20 PA-S | 30 DYNES/CM | 90% H20-10% IAL | Florescent Yellow |
| 5 | Black | 25 PA-S | 30 DYNES/CM | 90% H20-10% IAL | Florescent Green |

TABLE III

| PRINTER CHARACTERISTICS | | | |
|---|---|---|---|
| NUMBER | PRINT FONT | PRINT TYPE | PRINT RESOLUTION |
| 1 | ARIAL | REGULAR | 200 dpi |
| 2 | ARIAL | BOLD | 200 dpi |
| 3 | ARIAL | ITALIC | 200 dpi |
| 4 | ARIAL | REGULAR | 300 dpi |
| 5 | ARIAL | BOLD | 300 dpi |
| 6 | ARIAL | ITALIC | 300 dpi |
| 7 | ARIAL | REGULAR | 600 dpi |
| 8 | ARIAL | BOLD | 600 dpi |
| 9 | ARIAL | ITALIC | 600 dpi |
| 10 | ARIAL | REGULAR | 200 dpi |
| 11 | ARIAL | BOLD | 200 dpi |
| 12 | ARIAL | ITALIC | 200 dpi |
| 13 | ARIAL | REGULAR | 300 dpi |
| 14 | ARIAL | BOLD | 300 dpi |
| 15 | ARIAL | ITALIC | 300 dpi |
| 16 | ARIAL | REGULAR | 600 dpi |
| 17 | ARIAL | BOLD | 600 dpi |
| 18 | ARIAL | ITALIC | 600 dpi |

TABLE IV

| PAPER CHARACTERISTICS | |
|---|---|
| NUMBER | PAPER TYPE |
| 1 | REGULAR FLAT |
| 2 | MEDIUM SATIN |
| 3 | GLOSSY |
| 4 | HIGH GLOSS |

The data shown in the Tables I through IV above may be loaded and stored in a relational database of the processor 30, e.g., look-up tables. Table V below provides a look-up table of the drying times based upon the data of Tables I through IV. That is, various dryer configurations, i.e., Table I, are tested and analyzed in combination with the various print characteristics, i.e., Tables II, III and IV, to develop the various drying times.

TABLE V

| DRYING TIME | | | | |
|---|---|---|---|---|
| DRYER CONFIGURATION | INK | PRINT | PAPER | DRYING TIME |
| 1 | 1 | 1 | 1 | 5 seconds |
| 1 | 1 | 1 | 2 | 8 seconds |
| 1 | 1 | 1 | 3 | 10 seconds |
| 1 | 1 | 1 | 4 | 16 seconds |
| 1 | 2 | 1 | 1 | 6 seconds |
| 1 | 2 | 1 | 2 | 9 seconds |
| 1 | 2 | 1 | 3 | 12 seconds |
| 1 | 2 | 1 | 4 | 20 seconds |

TABLE V-continued

| DRYING TIME | | | | |
|---|---|---|---|---|
| DRYER CONFIGURATION | INK | PRINT | PAPER | DRYING TIME |
| 1 | 3 | 1 | 1 | 6 seconds |
| 1 | 3 | 1 | 2 | 10 seconds |
| 1 | 3 | 1 | 3 | 14 seconds |
| 1 | 3 | 1 | 4 | 22 seconds |
| 1 | 4 | 1 | 1 | 6 seconds |
| 1 | 4 | 1 | 2 | 10 seconds |
| 1 | 4 | 1 | 3 | 14 seconds |
| 1 | 4 | 1 | 4 | 22 seconds |
| 2 | 1 | 1 | 1 | 3 seconds |
| 2 | 4 | 1 | 2 | 5 seconds |

In. FIG. 3, the method and system of the present invention also includes a means for determining the print characteristics associated with a particular print job. That is, the processor 30 receives information (i.e., whether by direct operator input, sensed signals or a combination thereof) pertaining to the particular print job. This may include only one of the print characteristics, e.g., the type of ink used, or all characteristics including the print font, print type, resolution, paper type, etc.

In one embodiment of the present invention, a taggant may be introduced into the ink, i.e., in the ink cartridge, for identifying the ink. In the context used herein, a "taggant" is any chemical or physical marker added to the ink to facilitate testing and identification. The taggant may include a fluorescent pigment or dye introduced into the ink which responds to irradiation by light or other source of energy. The taggant may include magnetic or conductive particles suspended in the ink. For example, colloidal silver could be employed for detection in the presence of an electromagnetic field. Other examples include the use of copper, gold, cadmium, iron, etc. Taggants of the type described should be maintained at low concentration levels so as to avoid changes to the bulk ink properties.

In the described embodiment, the ink may include a fluorescent dye which responds to a source 40 of irradiation. Energy irradiated/released from the dye as its molecules return to their previously unexcited state is sensed by a detector 42 disposed upstream of the dryer 20. Having detected the ink, the processor 30 determines an optimum dryer configuration for the stacker 10 and issues signals to the various devices, e.g., the rheostat 26R, fan motor 24M, louver LVDT 26T, to configure the dryer 20 accordingly. While the optimum dryer configuration may frequently correlate to the shortest drying time, the drying time may desirably be another time period, i.e., something longer than shortest period. For example, to conserve energy, a longer period to dry the ink may be an acceptable alternative. The rules of optimization will be different depending upon the needs of a particular operator e.g., time available, and will not be discussed in greater detail herein. It is suffice to say that algorithms using rule-based logic will be employed to select the requisite drying time. However, upon selecting the drying time, the correlation data of the present invention is used to achieve the optimum dryer configuration.

Finally, the method and system may be used to vary the speed of the upstream and/or downstream conveyor belts. More specifically, conveyor belt motors 50 may be responsive to the processor 30 to increase or decrease the speed of the upstream and/or downstream belts. For example, a fast drying ink may enable additional mailpieces to be processed/stacked. Alternatively a slow drying ink may require that the speed of the downstream conveyor belt be increased to effect greater shingling between mailpieces, i.e., to prevent the ink of one mailpiece from contacting a surface of an adjacent mailpiece. Furthermore, since the speed of the conveyor belt impacts the time of ink exposure, i.e., exposure to the variable output dryer, a simple velocity calculation may be required to ensure adequate ink exposure. That is, the velocity of the mailpiece under the dryer must be taken into consideration, i.e., when constructing the optimization rules, to ensure that the ink will be exposed for the selected drying time.

It is to be understood that the present invention is not to be considered as limited to the specific embodiments described above and shown in the accompanying drawings. The illustrations merely show the best mode presently contemplated for carrying out the invention, and which is susceptible to such changes as may be obvious to one skilled in the art. The invention is intended to cover all such variations, modifications and equivalents thereof as may be deemed to be within the scope of the claims appended hereto.

The invention claimed is:

1. A method for drying printed ink on the face of a substrate material, comprising the steps of:

providing a dryer having at least one variable output element for producing a plurality of dryer configurations;

developing data correlating each of the dryer configurations with at least one print characteristic employed during print operations to determine a drying time associated with each, the at least one print characteristic is a taggant introduced into the printed ink; the taggant identifying the ink and its drying properties; and wherein the step of retrieving the print characteristic includes the step of sensing the taggant in the printed ink;

storing the developed data in a memory storage device;

obtaining the print characteristic associated with a particular print job and comparing the print characteristic with the developed data to define a dryer configuration;

adapting the dryer to assume the dryer configuration based upon the print characteristic; and, drying the ink printed on the face of the substrate material.

2. The method according to claim 1 wherein the print characteristic is determined by analyzing the print data of the print job for the font and type of the text printed on the substrate material.

3. The method according to claim 1 wherein the dryer includes a heating element energized by a supply of power and wherein the step of adapting the dryer to the optimum dryer configuration includes the step of:

varying the power supplied to a heating element of the dryer.

4. The method according to claim 1 wherein the dryer includes a propulsive fan for producing airflow and wherein the step of adapting the dryer to the optimum dryer configuration includes the step of:

varying the airflow produced by a propulsive fan in the dryer.

5. The method according to claim 1 wherein the dryer includes a ducting register defining a louver angle and wherein the step of adapting the dryer to the optimum dryer configuration includes the step of:

varying the louver angle of a ducting register in the dryer.

6. The method according to claim 1 wherein the dryer opposes a face surface of the sheet material and defines a proximity relative thereto and wherein the step of adapting the dryer to the optimum dryer configuration includes the step of:

varying the proximity of the dryer to the face surface of the sheet material.

7. The method according to claim 1 wherein the dryer includes a propulsive fan receiving an in-flow of air and wherein step of adapting the dryer to the optimum dryer configuration includes the step of:

varying the in-flow of air to a propulsive fan in the variable output dryer.

* * * * *